US010626599B2

(12) United States Patent
Negev

(10) Patent No.: US 10,626,599 B2
(45) Date of Patent: Apr. 21, 2020

(54) INTERLOCKING MASONRY BRICK

(71) Applicant: David Negev, Jerusalem (IL)

(72) Inventor: David Negev, Jerusalem (IL)

(73) Assignee: David Negev, Jerusalem (IL)

( * ) Notice: Subject to any disclaimer, the term of this patent is extended or adjusted under 35 U.S.C. 154(b) by 0 days.

(21) Appl. No.: 15/398,643

(22) Filed: Jan. 4, 2017

(65) Prior Publication Data

US 2017/0191259 A1 Jul. 6, 2017

Related U.S. Application Data

(60) Provisional application No. 62/275,311, filed on Jan. 6, 2016.

(51) Int. Cl.

| | |
|---|---|
| ***E04B 2/08*** | (2006.01) |
| ***E04C 1/41*** | (2006.01) |
| ***E04F 13/14*** | (2006.01) |
| ***E04B 2/02*** | (2006.01) |
| ***E04F 13/077*** | (2006.01) |

(52) U.S. Cl.

CPC ..... *E04B 2/08* (2013.01); *E04C 1/41* (2013.01); *E04F 13/077* (2013.01); *E04F 13/144* (2013.01); *E04B 2002/0269* (2013.01)

(58) Field of Classification Search

CPC ..... E02B 2/08; E04C 1/41; E04C 1/00; E04C 1/40; E04F 13/077; E04F 13/076; E04F 13/144; E04B 2/08

See application file for complete search history.

(56) References Cited

U.S. PATENT DOCUMENTS

| | | | | | |
|---|---|---|---|---|---|
| 4,229,497 | A * | 10/1980 | Piazza | B28B 19/003 | 264/256 |
| 4,478,021 | A * | 10/1984 | Person | B28B 15/00 | 52/309.7 |
| 4,641,470 | A * | 2/1987 | Baumberger | E04C 1/41 | 52/309.17 |
| 7,743,565 | B2 * | 6/2010 | Pyo | B28B 5/028 | 52/220.1 |
| 9,724,853 | B2 * | 8/2017 | Zavala | B29C 43/02 | |
| 2004/0148890 | A1 * | 8/2004 | Miniter | E04B 2/06 | 52/483.1 |
| 2010/0064622 | A1 * | 3/2010 | Kutlu | E04C 1/41 | 52/596 |
| 2012/0311953 | A1 * | 12/2012 | Antal | E04B 2/16 | 52/604 |
| 2014/0123583 | A1 * | 5/2014 | Arriola Serrano | E04B 2/06 | 52/405.1 |
| 2014/0260029 | A1 * | 9/2014 | Browning | E04C 1/41 | 52/309.4 |
| 2015/0059278 | A1 * | 3/2015 | Rainio | E02D 29/025 | 52/431 |
| 2017/0191259 | A1 * | 7/2017 | Negev | E04B 2/08 | |

* cited by examiner

*Primary Examiner* — Andrew J Triggs
(74) *Attorney, Agent, or Firm* — The IP Law Firm of Guy Levi, LLC

(57) ABSTRACT

The disclosure is directed to thermal and moisture insulated interlocking brick comprising natural, in-situ carved stone façade coupled to a backing layer comprised of a massive and lightweight portions, as well as methods of forming the brick and methods for cladding and using the bricks in load bearing walls and in non-load-bearing walls (light construction).

11 Claims, 7 Drawing Sheets

INTERLOCKING MASONRY BRICK

BACKGROUND

The disclosure generally relates to interlocking masonry panels having adhered natural stone façade used for cladding. More particularly, the disclosure relates to a thermally and moisture insulated brick comprising natural, carved stone façade coupled to lightweight and/or massive concrete backing and methods for their forming.

Most modern residential and light commercial designs use platform framing, involves poured in place column-and-slab techniques or skeletonized construction employing a framework of steel girders as a support for precast concrete members.

When cladding requires carved, natural stone façade, either by architects or regulation, to maintain consistency or due to conservation consideration, constraints on construction may become significant.

Carving of the stone itself, permanently anchoring the stone to the support walls, structural integrity of the structure as well as aesthetics, are all issue that remain in the industry and require attention.

SUMMARY

Disclosed, in various embodiments, are embodiments of thermally and moisture insulated bricks comprising natural, carved stone façade coupled to light weight and/or massive concrete backing and methods for their production.

In an embodiment, provided herein is an interlocking masonry brick having a front surface, a backing, an upper interface, a lower interface, a left interface and a right interface comprising:a carved natural stone façade forming the front surface; a light and or (optionally fortified) concrete forming the backing; and an intermediate moisture insulating layer sandwiched between the carved natural stone façade and the backing, wherein the lower interface defines a groove configured to receive and engage a tongue defined by the upper interface of an adjacent brick, and wherein the left interface defines a groove configured to receive and engage a tongue defined by the right interface of an adjacent brick, the upper, lower, right and left interfaces comprised of concrete that is comprised of the same components comprising the backing concrete.

In another embodiment, provided herein is a method of forming an interlocking masonry brick having a front surface of a craved stone, a backing, an upper interface, a lower interface, a left interface and a right interface comprising: providing a quadrilateral brick mold defining an open frame having an upper interface, a lower interface, a right interface and a left interface, wherein: the upper and lower interfaces are identical and parallel, defining a line cross section with at least two angles therein; and the right and left interfaces are identical and parallel, defining a line cross section with at least two angles therein; positioning a natural stone uncarved, substantially rectangular slab in a brick mold, wherein the natural stone uncarved, substantially rectangular slab forms the floor of the open frame; depositing a concrete mixture comprising cement to sand at a ratio of between 1:1 and 1:3, wherein the sand has particle size equal to or less than 1 mm into the frame, forming an open box with straight sides rising above the slab; depositing an intermediate moisture insulating layer on the slab; depositing a light and/or a massive (optionally fortified) concrete mixture atop the intermediate moisture insulating layer, to the top of the box; drying the brick; and carving the stone.

In yet another embodiment, provided herein is a method of cladding a structure having solid load-bearing concrete walls with carved natural stone façade comprising: providing a plurality of bricks each brick comprising: carved natural stone façade forming the front surface; a light and/or massive concrete forming the backing; and an intermediate moisture insulating layer sandwiched between the carved natural stone façade and the backing, wherein the lower interface defines a groove configured to receive and engage a tongue defined by the upper interface of an adjacent brick, and wherein the left interface defines a groove configured to receive and engage a tongue defined by the right interface of an adjacent brick, the upper, lower, right and left interfaces comprised of concrete that is different than the backing concrete; constructing a concrete pouring mold for the load bearing wall; on a floor platform, erecting a wall formed of rows and columns of the plurality of bricks, wherein an anchor extends every $3^{rd}$ or $4^{th}$ row and every $3^{rd}$ or $4^{th}$ column into the mold; and pouring the load bearing concrete into the mold.

These and other objectives and advantages of the present technology will become understood by the reader and it is intended that these objects and advantages are within the scope of the present invention. To the accomplishment of the above and related objects, this disclosure may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE FIGURES

For a better understanding of the thermally and moisture insulated bricks comprising natural, carved stone façade coupled to lightweight and/or (fortified) massive concrete backing and methods for their production in the various embodiments thereof, reference is made to the accompanying drawings, in which like numerals designate corresponding elements or sections throughout and in which.

Figure 11A:
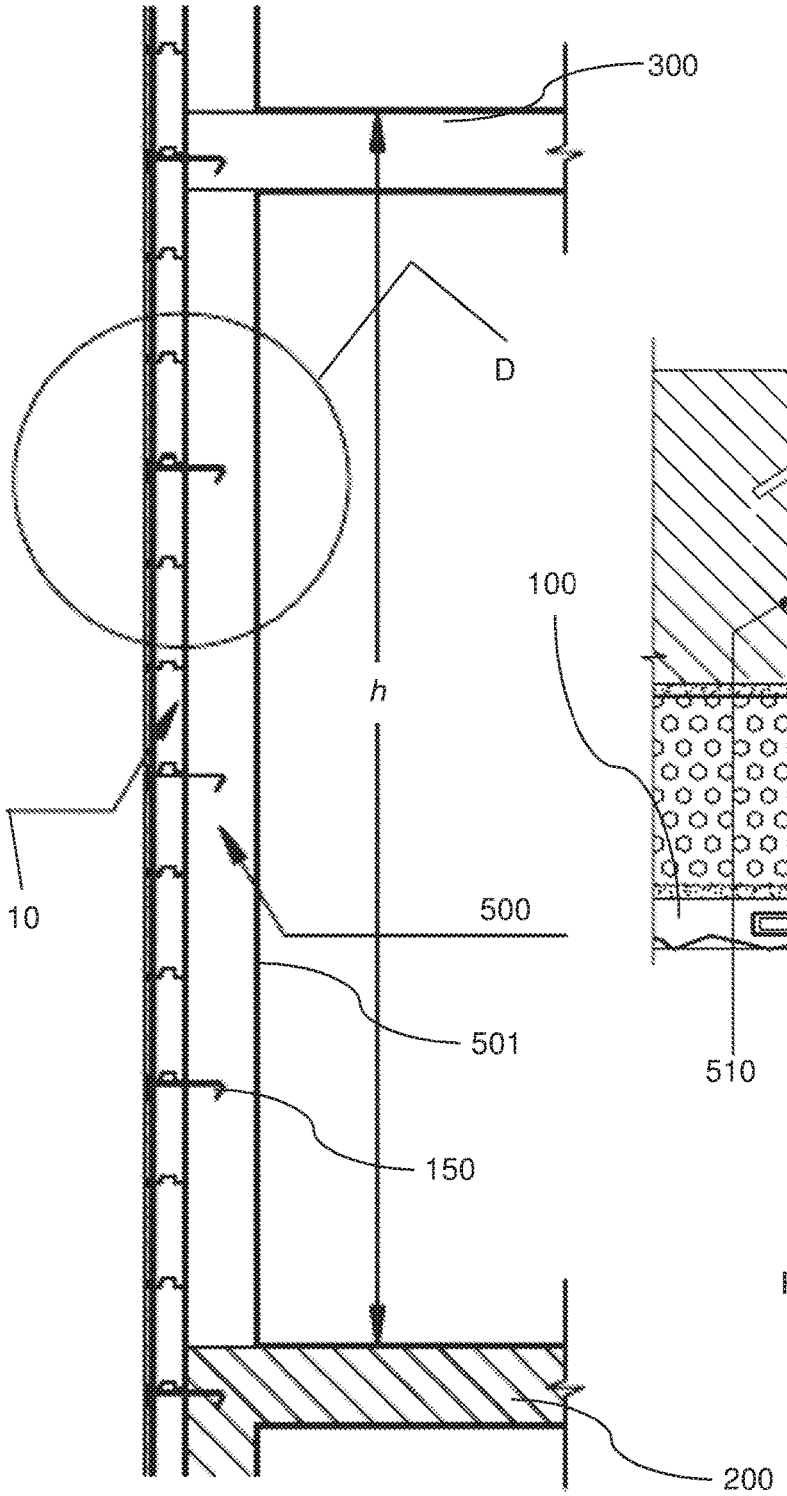
FIG. 11A illustrates X-Z cross section of a structure having solid load-bearing concrete walls cladded with carved natural stone façade bricks with a first anchor type, an enlarged portion thereof in FIG. 11B, X-Z cross section of a structure having solid load-bearing concrete walls cladded with carved natural stone façade bricks with another anchor type in FIG. 11C, an enlarged portion E (FIG. 11C)
Figure 11B:
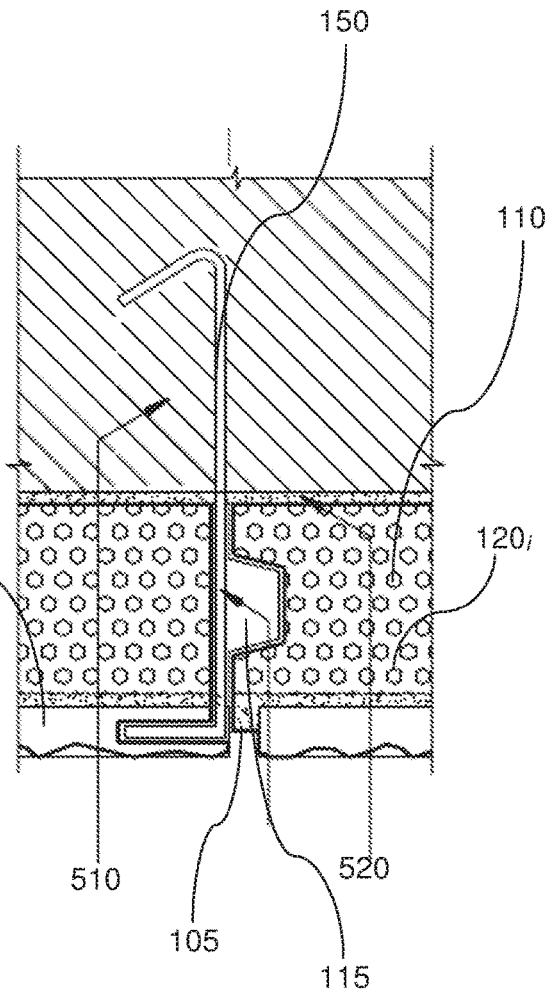
Figure 11C:
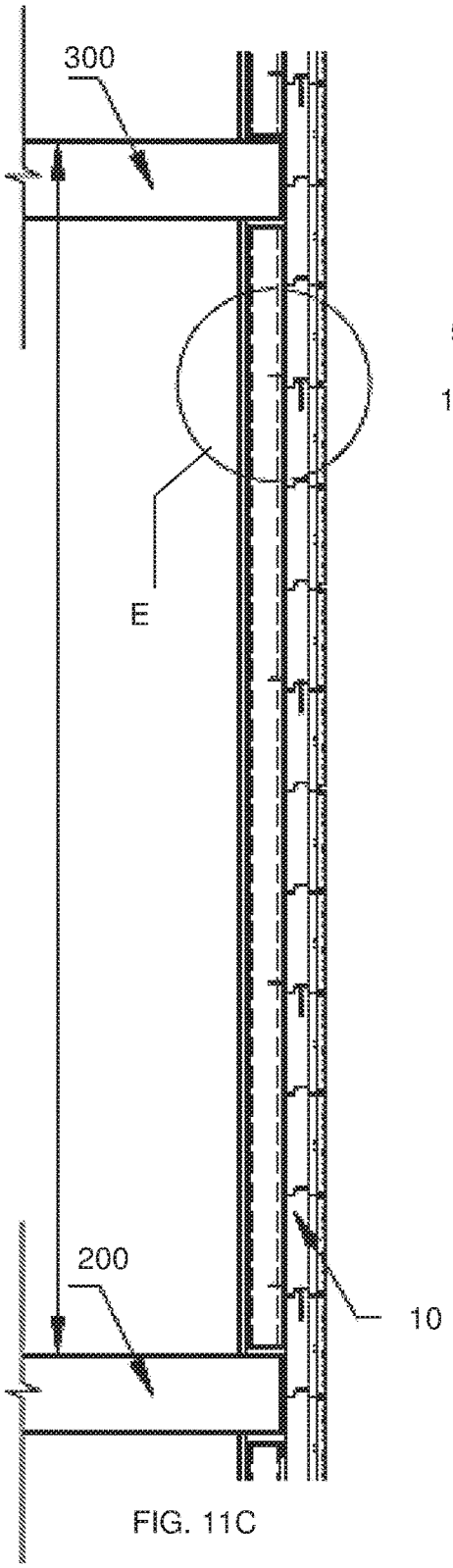
Figure 11D:
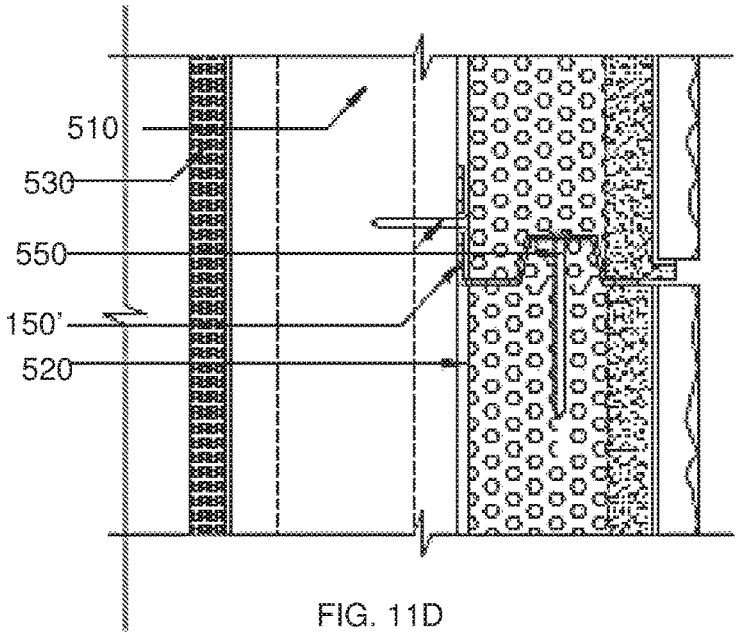
Figure 11E:
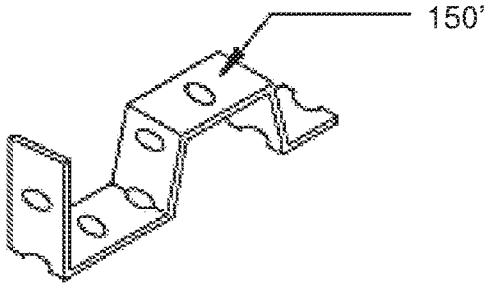

thereof in FIG. 11D, and an embodiment of a profile for the other anchor type in FIG. 11E.

DESCRIPTION

Provided herein are embodiments of thermally and moisture insulated bricks comprising natural, carved stone façade coupled to lightweight and/or (optionally fortified) massive concrete backing and methods for their production.

Accordingly and in an embodiment, provided herein is an interlocking masonry brick having a front surface, a backing, an upper interface, a lower interface, a left interface and a right interface comprising:a carved natural stone façade forming the front surface; a light concrete forming the backing; and an intermediate moisture insulating layer sandwiched between the carved natural stone façade and the backing, wherein the lower interface defines a groove configured to receive and engage a tongue defined by the upper interface of an adjacent brick, and wherein the left interface defines a groove configured to receive and engage a tongue defined by the right interface of an adjacent brick, the upper, lower, right and left interfaces comprised of concrete that can be different than, or the same as the backing concrete. In an embodiment, the groove in the lower interface and left interface, is configured to receive and engage the tongue in the upper interface and the right interface respectively, causing the carved stone façade of a first brick to abut the carved stone façade of a second adjacent brick. In other words, the interlocking brick does not leave any distance between adjacent bricks, whether in a row or in a column.

The term "engage" and various forms thereof, when used with reference to the tongue and groove engagement, refer to the application of any forces that tend to hold the bricks together against inadvertent or undesired separating forces (e.g., such as may be introduced during pouring of load-bearing walls). It is to be understood, however, that engagement does not in all cases require an interlocking connection that is maintained against every conceivable type or magnitude of separating force.

The brick can be a substantially rectangular slab (referring to a solid block wherein the thickness is substantially smaller than any other dimension of the block), with an aspect ratio between length and width of about 1:1 and 4:1, with ratio of thickness to length of between about 1:3 and 1:10. The length of the brick (or block), can be between about 30 cm and about 100 cm. The term interface, and its derivatives (e.g., upper, lower etc.) refers in an embodiment, to the surfaces exposed to, and in contact with other bricks or support platforms (e.g., ceiling, floor, etc.). Interfaces can the side walls forming the external frame of the slab. The terms "slab", "block", "panel" and "brick", are used herein interchangeably and are intended to encompass a mass of material that is compact and solid, and having a variety of shapes and thicknesses. Likewise, the term "façade" refers in an embodiment, to a non-structural facing of stone, interior or exterior, serving as ornamentation and a weather barrier.

As described in the methods provided, a workable mixture is prepared comprising materials extracted from the ground of the site or materials brought in from elsewhere or a mixture of both, together with at least one binder, and said mixture is deposited in a dedicated molding grid, the brick being the result of said mixture setting. The mixture can be sufficiently workable to enable it to be cast into the molding grid. The nature of the materials and the proportion of binder suitable for use in making such a brick can be a function of the natural stone sought to be used in the brick.

The natural carved stone used in the thermally and moisture insulated brick (or block) provided herein can be, for example, limestone. Other examples can be granite, or gabbro, granodiorite, syenite, larvikite, diorite, gabbro, rhyolite, quartz porphyr, andesite, trachyte, kuselite, porphyr, basalt, lava, melaphyr, diabase, picrite, marble, gneiss, serpentinite, Jura limestone, shell limestone, travertine, dolomite, onyx, alabaster, sandstone, glauconite sandstone, greywacke, shale, quartzite, or a natural stone aggregate comprising a combination of one or more of the foregoing. The natural stone can be set using the methods described herein in its raw state, as delivered from the quary and carving can be done on the molded brick (or slab).

On arrival, the natural stone can be initially cut according to the type of carving technique desired. These techniques can be for example, lithic reduction, pitched face, ground face, acid etching, sawing, planning, turning cutting or a combination thereof. The methods provided herein can use a natural stone of about half the thickness that would be necessary without the coupling of the initially-uncarved natural stone to the backing described herein. The finished carved stone façade can have an average thickness of between about 5 mm and about 50 mm, or between about 10 mm and about 25 mm. More specifically, the carved stone, finished while on the brick (or panel, or slab, or block), can have a thickness of between about 15 mm and about 20 mm, depending on the desired final brick weight, type of finish, and the stone used among other factors.

The uncarved natural stone can have a carving face and a backing face, where the degree of surface roughness (referring in an embodiment, to the average peak-to-valley distance, is less than the carving face's and could be between about 0.50 to about 5.00 mm on average. The intermediate layer, coupling the as-yet uncarved stone slab to the backing, used in the bricks, panels, slabs and blocks described herein and the methods for their forming, can be a mixture of cementitious material and water, with or without aggregate (e.g., sand having particle size $D_{3,2}$ equal to or less than about 1.0 mm, depending on the thickness of the grout necessary to achieve target weight), proportioned to produce a ductile plastic consistency without segregation of the constituents with or without other additives. The intermediate layer can be used to adhere the natural stone's backing face to the backing layer through filling the rough surface and rising above to a thickness of between about 1.0 mm and about 4.0 mm.

The backing used in the bricks, panels, slabs and blocks described herein and the methods for their forming, may be composed of two types of layers. A first, lightweight concrete comprised of cement with and/or without sand at a ratio of 1:0 to 1:3 and can have a density of between 200 about kg/m$^3$ and about 1000 kg/m$^3$. The light concrete can further comprise between about 20% and 70% (volume of the brick occupied by the expanded particles/total volume of the backing layer (v/v)), for example, 35% (v/v) expanded polystyrene (or other suitable polymer) particles having n $D_{3,2}$ (in other words, the ratio between the average particle volume to the average particle surface area assuming spherical particles) of between about 1.0 and about 8.0 mm. The spherical nature of the expanded particle may be beneficial as it is the most efficient ratio between volume and surface area, thus providing consistent insulation when dispersed in the backing, as well as transferring of stress forces throughout the molded brick. Accordingly, in an embodiment, the expanded particles can be spherical particles. Alternatively the use of other expanded particles like volcanic aggregates for example: pumice stone or use of other lightweight concrete like YTONG™ aerated Concrete panels is possible for forming the lightweight layer.

The backing can also comprise an additional, massive layer that can have a density of between 2000 about kg/m$^3$ and about 2750 kg/m$^3$. The ratio between the backing's lightweight layer and massive layer can be between about 1:1 and about 10:1, and will depend on, for example, the type, weight, thickness and masonry processing of the natural stone used with the brick. For example, the more fragile and thinner the desired natural stone, the lower will be the ratio between the lightweight and massive (heavy) and optionally fortified layer.

In certain embodiments, the massive concrete layer used in the bricks and methods described herein can comprises a mixture of cement and sand at a ratio between about 1:1 and about 1:2; and gravel (and/or other similar natural or synthetic aggregate), at a ratio of 3:2 relative to the cement:sand mixture, wherein the gravel has an average particle size of about 5.0 mm (about No. 4 mesh). The term "gravel" is somewhat loosely applied in the art to encompass hard, rigid particulate matter ranging in size from a coarse sand to pebble size material. Suitable gravel particulates include, but are not limited to, sand, bauxite, ceramic materials, glass materials, polymer materials, polytetrafluoroethylene materials, nut shell pieces, seed shell pieces, fruit pit pieces, wood, composite particulates, proppant particulates, and combinations thereof. Suitable composite materials may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. In certain exemplary embodiments, the particulates may comprise common sand. Suitable particulates may take any shape including, but not limited to, the physical shape of platelets, shavings, flakes, ribbons, rods, strips, spheroids, ellipsoids, toroids, pellets, tablets.

The interfaces of the bricks, panels, slabs and blocks described herein, formed using the methods described herein, can be of a composition that is different than the intermediate layer and/or the lightweight concrete backing, or in another embodiment, having the same composition and differently tinted and may comprise a mixture of cementitious material and water, with or without aggregate whereby the cement to sand can be at a ratio between 1:1 and 1:3, and wherein the sand can have particle size ($D_{3,2}$) that is equal to or less than 1 mm and further be coated with additional moisture barrier. Same composition can be used for the fortifying layer. Moreover, the interfaces can be further formed of pigmented materials (or otherwise tinted) thus be in a different color than the backing material, thereby providing visual indication of the quality of coupling of the bricks, as well as adding an ornamental element to the façade.

The weight of the bricks, panels, slabs and blocks described herein can be equal to or greater than the weight of a 100% stone brick, panel, slab or block of the same area with a thickness of about 50 mm. In other words, the thickness of the intermediate layer, the backing layer(s), as well as the volume percent of the expanded polymer particles (spheres) and the strip layer forming the interface frame around the stone perimeter are optimized to provide proper adhesion and sealant properties, as well as thermal insulation properties (in other words, low thermal conductivity, 'k' of for example, between about 0.6 W/mK and 0.7 W/mK)and proper interlocking commensurate with the construction area, and the stone used.

For example, in an embodiment, the brick formed is substantially rectangular brick having a longitudinal axis of 60 cm, and a transverse axis of 30 cm, providing surface area of 1800 cm$^2$, with 5.0 cm thickness, a stone brick of lime stone ($\rho$=2.54 g/cm$^3$) with the same dimensions and average backing face roughness of about 1.0 mm, would weigh about $$22.9\ \text{Kg} = \left(60\ \text{cm} \times 30\ \text{cm} \times 5\ \text{cm} \times \frac{2.54\ \text{g}}{\text{cm}^3}\right).$$

Next, assuming (for example) intermediate layer with set density of 1.50 g/cc; lightweight/massive backing with 35% v/v expanded polystyrene (EPS) with a thickness ratio of lightweight cement and massive cement yielding average backing layer density of 0.9 g/cc; and interface (frame) forming layer having a density of 1.55 g/cc one could arrive at the required dimensions.

EXAMPLE 1

Brick Dimensions Calculations for Limestone Façade with Fixed Dimensions (60 cm×30 cm×2.0 cm)

| Layer | Boundary conditions | Weight (Kg) |
|---|---|---|
| Stone: Limestone | In this example, one degree of freedom, the thickness of the carved limestone is sacrificed and fixed at 20 mm (2.0 cm) e.g., for the degree of roughness necessary to achieve the aesthetic impact required | 9.144 |
| Intermediate | Next, the intermediate, moisture repellent adherence layer is calculated at 3 mm (1 mm to fill surface roughness and 2 mm above) | 0.810 |
| Interface layer, Lightweight backing layer | Allowing for tongue and groove with minimum 5.0 cm combined thickness and about 5 mm (0.5 cm) solid strip around the perimeter of the stone (180 cm) the remaining parameter is the width of the interface layer strip around the perimeter of the stone (see e.g., FIG. 1). If the purpose is to maximize the thickness of the lightweight concrete backing layer (e.g., for increased thermal insulation), the thickness of the lightweight concrete backing (which can be equal to the width of the interface strip, is 4.1 cm | 12.946 |
| Final brick dimensions | 65.5 cm l × 35.5 cm w × 6.2 cm h | 22.9 Kg |

EXAMPLE 2

Brick Dimensions Calculations for Granite Fixed Façade Dimensions (60 cm×30 cm×2.0 cm)

As in Example 1, the brick dimensions remain the same however the stone selected is granite ($\rho$=2.75 g/cm$^3$)with backing face roughness of 0.5 mm average yielding target weight of 24.75 Kg.

| Layer | Boundary conditions | Weight (Kg) |
|---|---|---|
| Stone: Granite | fixed at 20 mm (2.0 cm) e.g., for supporting structural integrity | 9.9 |
| Intermediate | Next, the intermediate, moisture repellent adherence layer is calculated at 2.5 mm (0.5 mm to fill surface roughness and 2 mm above) | 0.0.675 |
| Interface layer, backing layer with a thickness ratio of lightweight cement and massive cement yielding average backing layer density same as Example 1* | Allowing for tongue and groove with minimum 5.0 cm combined thickness and about 5 mm (0.5 cm) solid strip around the perimeter of the stone (180 cm) the remaining parameter is the width of the interface layer strip around the perimeter of the stone (see e.g., FIG. 1). If the purpose is to maximize the thickness of the lightweight concrete backing layer (e.g., for increased thermal insulation), the thickness of the lightweight concrete backing (which can be equal to the width of the interface strip, is 4.5 cm | 12.946 |
| Final brick dimensions | 65.5 cm l × 35.5 cm w × 6.7 cm h | 22.9 Kg |

*Here Granit is harder than limestone, which will allow for a higher ratio of lightweight backing layer to massive backing layer without jeopardizing the integrity of the brick during masonry processing.

EXAMPLE 3

Carved Sandstone (Limestone) Façade Thickness with Fixed Total Brick Dimensions of (60 cm×30 cm×10.0 cm)

Unlike Example 2, the stone façade area is fixed at 60 cm 1×30 cm w, while total brick dimensions are set at 65.5 cm l×35.5 cm w×10 cm h. Moreover the stone selected is travertine ($\rho$=2.5 g/cm$^3$) with backing face roughness of 0.1 mm average yielding target weight of 22.5 Kg.

| Layer | Boundary conditions | Weight (Kg) |
|---|---|---|
| Stone: Sandstone | Final stone thickness set at thickness minimizing total brick weight while still adding up to total brick thickness of 10 cm, while maintaining structural integrity of the natural travertine finalized at 1.1 | 4.95 |
| Intermediate | the intermediate, moisture repellent adherence layer is calculated at 3 mm (1 mm to fill surface roughness and 2 mm above) | 0.810 |
| Interface layer, | Allowing for tongue and groove with minimum 5.0 cm combined thickness and about 5 mm (0.5 cm) solid strip around the perimeter of the stone (180 cm) with the width of the interface layer strip around the perimeter of the stone (see e.g., FIG. 1) set at 10 cm. | 15.345 |
| backing layer with a thickness ratio of lightweight cement and massive cement yielding average backing layer density of EX. 1 | Again, if the purpose is to maximize the thickness of the lightweight concrete backing layer (e.g., for increased thermal insulation), the thickness of the lightweight concrete backing (which can be equal to the width of the interface strip, is 9.7 cm | |
| Final brick dimensions | 65.5 cm l × 35.5 cm w × 10 cm h | 25.8 Kg |

*Here sandstone is softer than granite and limestone, which may require a lower ratio of lightweight backing layer to massive backing layer, which, to obtain the required overall density of the backing layer, can be achieved, for example, by modulating the initial density of each of the massive and lightweight backing layers..

Other similar calculations can be made for increasing or decreasing the fractional concentration of EPS (or EPU) and incorporating heat transfer coefficient while forming the bricks. In an embodiment, the total weight of each brick is fixed at about 30 kg and the dimensions of each layer at a fixed brick size are determined.

EXAMPLE 4

Sandstone Results

A brick using Sandstone was prepared according to the methods described herein (See e.g., Example 3).

The bricks were subjected to adherence and compressive strength tests. To test the adherence strength and compressive strength of the natural stone to the backing layer, bricks having dimensions of 250 mm (W)×400 mm (L)×120 mm (h) were produced. The bricks had a stone layer of about 20 mm, an intermediate layer of about 1.0 mm, 20 mm of a massive ($\rho$=2,400 Kg/m$^3$) backing layer and about 80 mm light concrete layer ($\rho$=280 Kg/m$^3$).

To test the adherence strength, the samples were tested according to the Israeli Standard Institute test No. 1555/3. In short, cylinders of about 50 mm diameter at a predefined depth of less than the thickness of the natural stone layer (e.g., NMT 20 mm), were cut into the stone and pulled to failure at increased force. Results show an average strength of adherence to be between about 0.5 and about 1.0 MPa. Failure points were detected mainly within the massive backing layer.

To test the compressive strength, the same brick type was tested according to the Israeli Standard Institute test No.5/1. In short, a press was applied to a predetermined area of the brick façade on the stone side and the pressure increased to the point of failure. Results show an average compressive strength of between about 5.0 and about 10 MPa.

EXAMPLE 5

Heat Transfer Coefficient of Light Concrete Layer

Bricks with only a light layer having dimensions of 300 mm (W)×300 mm (L)×51 mm (h) were used to test the heat transfer coefficient. The light concrete layer comprised 10% (v/v) of EPS having $D_{3,2}$ of about 1 mm and 60% (v/v) of EPS with $D_{3,2}$ of about 4.5 mm. The remaining formulation was as described herein (cement and additive).

To test the heat transfer coefficient, the samples were tested according to the Israeli Standard Institute test No. 5450. The sample was heated using about 0.3 W with temperature on the cold side showing about 5° C. and about 15° C. on the warm side. Heat transfer coefficient calculated upon the brick obtaining mean temperature of about 10° C. The heat transfer coefficient was between about 0.20 W/m·K to about 0.05 W/m·K.

In an embodiment, the bricks provided herein are formed using the methods described. Accordingly and in an embodiment, provided herein is a method of forming an interlocking masonry brick having a front surface, a backing, a strip disposed around the perimeter of the brick forming an upper interface, a lower interface, a left interface and a right interface, the method comprising the steps of: providing a quadrilateral brick mold defining an open frame defining an upper interface, a lower interface, a right interface and a left interface, wherein: the upper and lower interfaces can be identical and parallel with the interface defining a line cross section with at least two angles therein. In other words, the interface defines an indentation. Likewise, the right and left interfaces can be identical and parallel, also defining a line cross section with at least two angles therein, which can be the same or different as the cross section of the upper and lower interfaces (see e.g., FIG. 9). A natural stone can be positioned—uncarved, substantially rectangular slab in a brick mold, wherein the natural stone—uncarved, substantially rectangular slab forms the floor of the open frame formed by the profiles configured to provide tongue and grove on the interfaces. A concrete mixture comprising cement to sand at a ratio of between 1:1 and 1:3, wherein the sand has particle size equal to or less than 1 mm is poured (deposited) into the frame, forming the perimeter walls of an open box with straight internal sides rising above the slab, and a tongue on the upper interface and left interface, and a groove on the lower interface an right interface. An intermediate moisture insulating layer is deposited on the slab, which is used to adhere the stone to the lightweight backing layer. The intermediate layer in addition, fills the roughened surface of the uncarved stone (average Ra can be, for example between 0.5 mm and 5 mm). A massive (optionally fortified) backing layer can then be deposited atop the intermediate moisture insulating layer, followed by lightweight concrete mixture is then deposited atop the massive backing layer, to the top of the box formed by the interface strip disposed around the perimeter of the stone; drying the brick; and carving the stone.

The uncarved, natural stone slab can have two sides. A carving side (referring to the side facing the outside of the structure) and a backing side (the side on which the intermediate, moisture insulating layer is being pored on) and whereby the slab is positioned in the mold carving side down, the backing side having a rough (e.g., irregular) surface with an average surface roughness of between about 0.5 mm and 5.0 mm.

Prior to carving, and following some drying, the brick can be removed from the mold and then transferred to be carved. Once carved, the brick having a natural stone façade, a moisture insulating layer, a thermal insulating layer (in other words, low thermal conductivity, 'k' of, for example, between about 0.6 W/mK and 0.7 W/mK), and the interface strip with tongue and groove on opposite sides of the brick, can be assembled for cladding (in other words, insulating buildings thermally and against moisture on external walls of the building) a structure with poured, load bearing concrete walls. Accordingly and in another embodiment, provided herein is a method of cladding a structure having solid load-bearing concrete walls with carved natural stone façade comprising: providing a plurality of bricks each brick comprising: a carved natural stone façade forming the front surface; a concrete forming the backing, the backing comprising a massive layer and a lightweight layer; and an intermediate moisture insulating layer sandwiched between the carved natural stone façade and the backing, wherein the lower interface defines a groove configured to receive and engage a tongue defined by the upper interface of an adjacent brick, and wherein the left interface defines a groove configured to receive and engage a tongue defined by the right interface of an adjacent brick; constructing a concrete pouring mold for the load bearing wall; on a floor platform, erecting a wall formed of rows and columns of the plurality of bricks, wherein an anchor extends as needed every predetermined number of rows and/or columns (e.g., 3$^{rd}$ or 4$^{th}$ row and every 3$^{rd}$ or 4$^{th}$ column) into the mold; and pouring the load bearing concrete into the mold.

The mold can be formed of a mesh of wires and planks to which the load bearing concrete walls can be poured. Prior to pouring the concrete-load bearing walls, the backing layer can be coated with an additional moisture barrier or waterproofing, for example, a membrane, sheet of plyethylene, latex, polyurethane coating and the like.

A support mesh can be coupled to the structured. However, non-mesh supports could also be used. For example, a reinforcing wire mesh can be placed at least 1.5 cm below the desired top surface of the concrete façade and within 1 cm above the surface of the existing façade of the structure. The support mesh used in the methods described herein can be, for example, an wrought iron lattice, composite mesh, woven fabric mesh, mesh wire, or a combination comprising at least one of the foregoing.

The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection The term "about", when used in the description of the technology and/or claims means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such and may include the end points of any range provided including, for example ±25%, or ±20%, specifically, ±15%, or ±10%, more specifically, ±5% of the indicated value of the disclosed amounts, sizes, formulations, parameters, and other quantities and characteristics.

The terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the aggregate(s) includes one or more aggregates). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

A more complete understanding of the components, methods, and devices disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof, their relative size relationship and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function. Likewise, cross sections are referred to on normal orthogonal coordinate apparatus having XYZ axis, such that Y axis refers to front-to-back, X axis refers to side-to-side, and Z axis refers to up-and-down.

Figure 1:
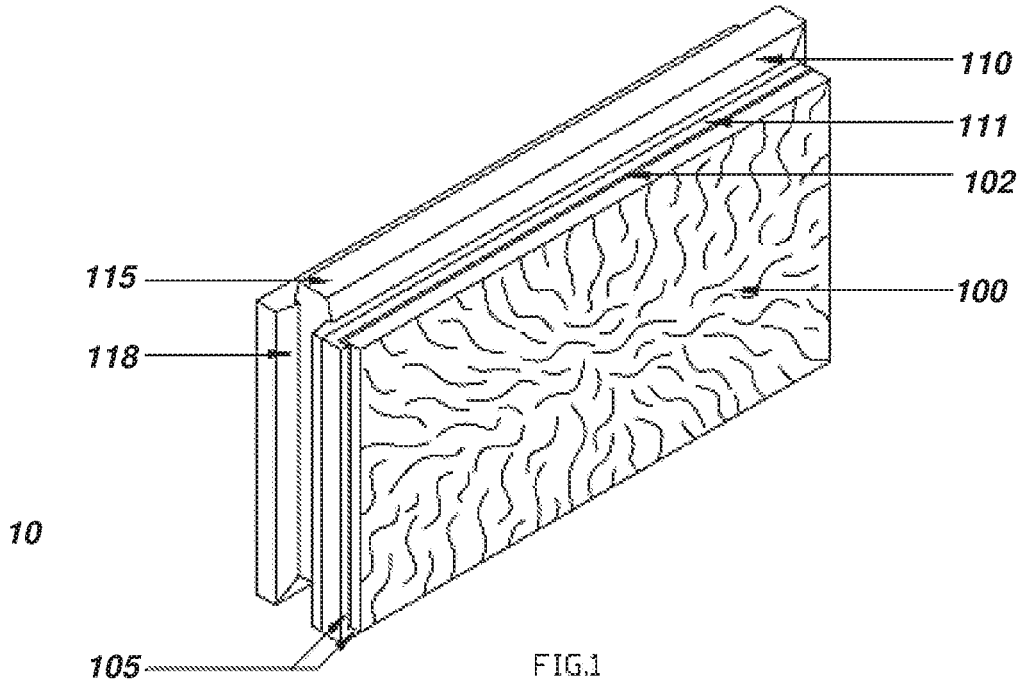
FIG. 1, illustrates a schematic perspective of an embodiment of the thermally and moisture insulated bricks comprising natural, carved stone façade described and claimed.
Figure 2:
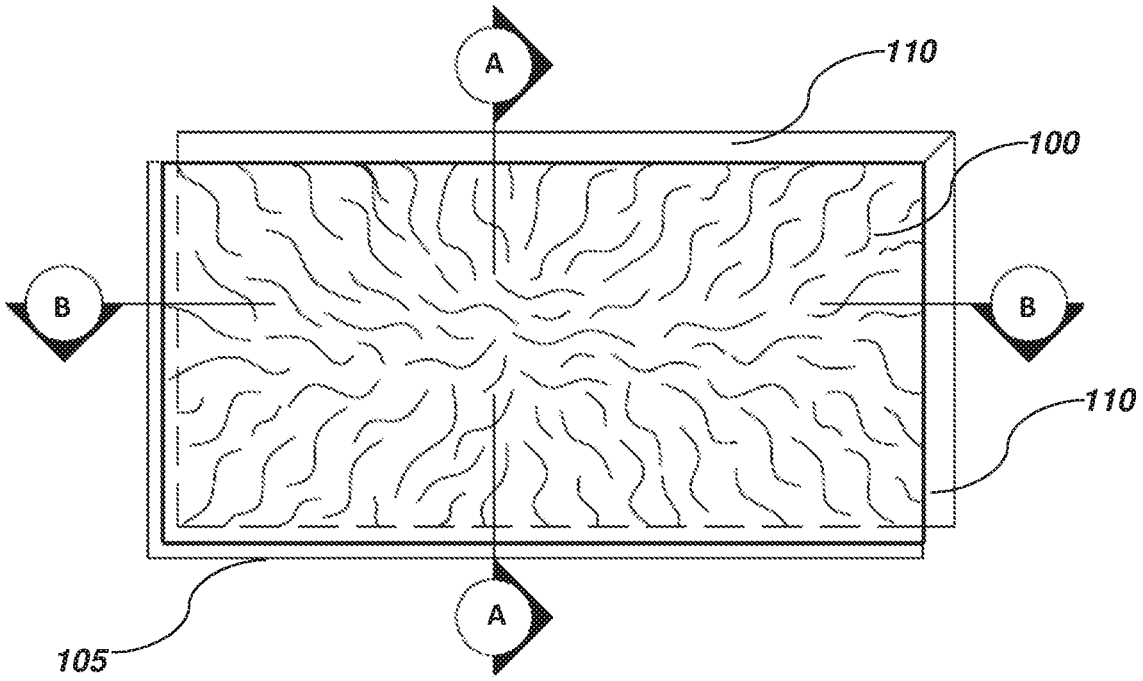
FIG. 2 illustrates a front elevation view of an embodiment of the thermally and moisture insulated bricks comprising natural, carved stone façade described and claimed.
Figure 3:
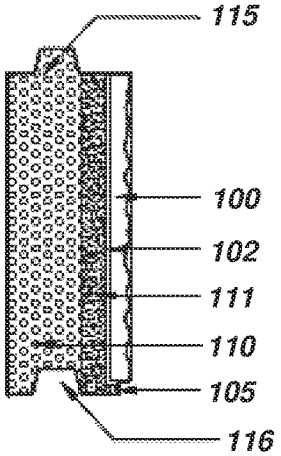
FIG. 3, illustrates a Z-Y Cross section A-A in FIG. 2.
Figure 4:
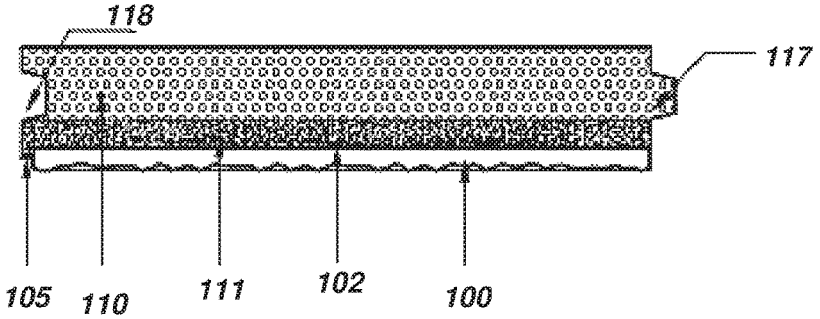
FIG. 4, illustrates a X-Y cross section B-B in FIG. 2 for a plurality of the thermally and moisture insulated bricks comprising natural, carved stone façade.
Figure 5:
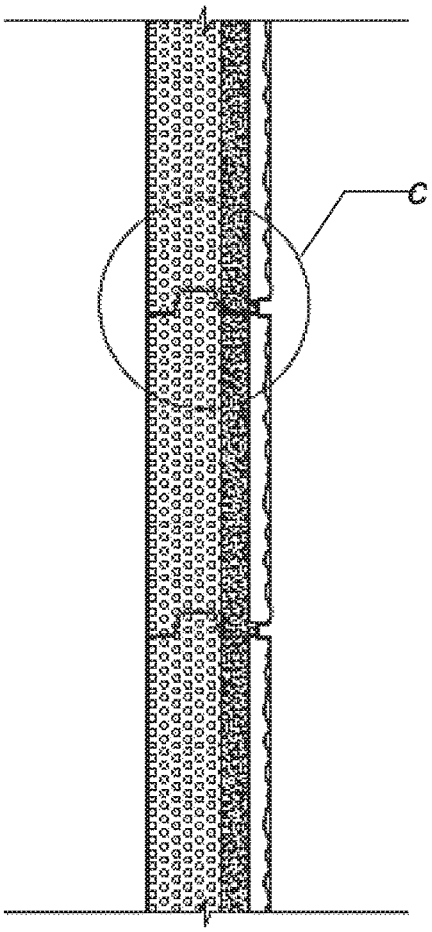
FIG. 5, illustrates a vertical wall section.
Figure 6:
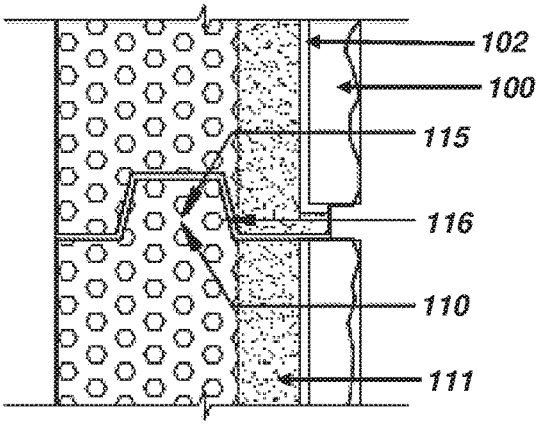
FIG. 6, shows enlarged portion C in FIG. 5.

Turning now to FIGS. 1-6, illustrating in FIG. 1, a perspective of an embodiment of thermally and moisture insulated bricks 10 comprising natural, carved stone façade 100. As illustrated, interlocking masonry brick 10 having a front surface, a backing, an upper interface, a lower interface, a left interface and a right interface comprising: carved natural stone façade 100 forming the front surface; massive backing layer 111; lightweight backing layer 110; and intermediate moisture insulating layer 102 sandwiched between carved natural stone façade 100 and massive backing layer 111, wherein lower interface defines groove 116 (see e.g., FIG. 3) configured to receive and engage tongue 115 (see e.g., FIG. 3) defined by the upper interface of an adjacent brick, and wherein left interface defines groove 118 (see e.g., FIG. 4) configured to receive and engage tongue 117 defined by the right interface of adjacent brick 10, (see e.g., FIG. 4), upper 115, lower 116, right 117 and left 118 (see e.g., FIGS. 3,4) interfaces forms a strip around brick 10 and can be comprised of concrete that is differentthan lightweight backing concrete 110 (see e.g., FIG. 4) but is the same as massive backing layer 111 (see e.g., FIG. 4). Intermediate layer 102 can extend to the gap created between the stone façade slabs 105 (see e.g., FIG. 2, 6) can be disposed below to one side of the carved stone and can be considered as an architectural element and be comprised of the massive backing layer. As shown in FIG. 6, lightweight backing layer 110, can comprise expanded polymer particle spheres 1201, having and average diameter $D_{3,2}$ of between about 1.8 mm and about 5.0 mm.

Figure 7:
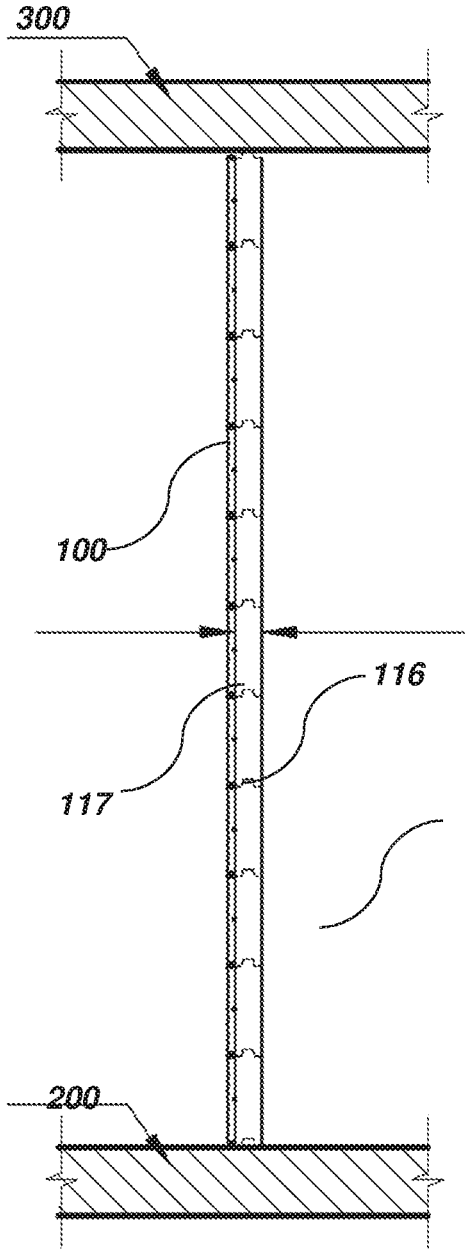
FIGS. 7 and 8, illustrates a wall having one stone side (FIG. 7) and a second embodiment with stone façade on both sides of a wall (FIG. 8)
Figure 8:
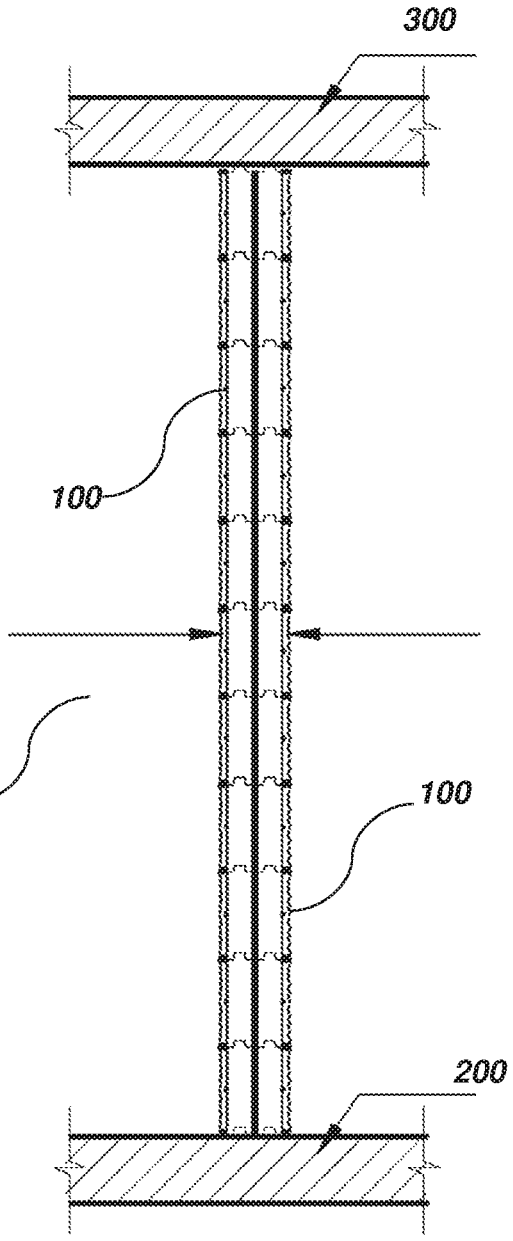
Figure 9:
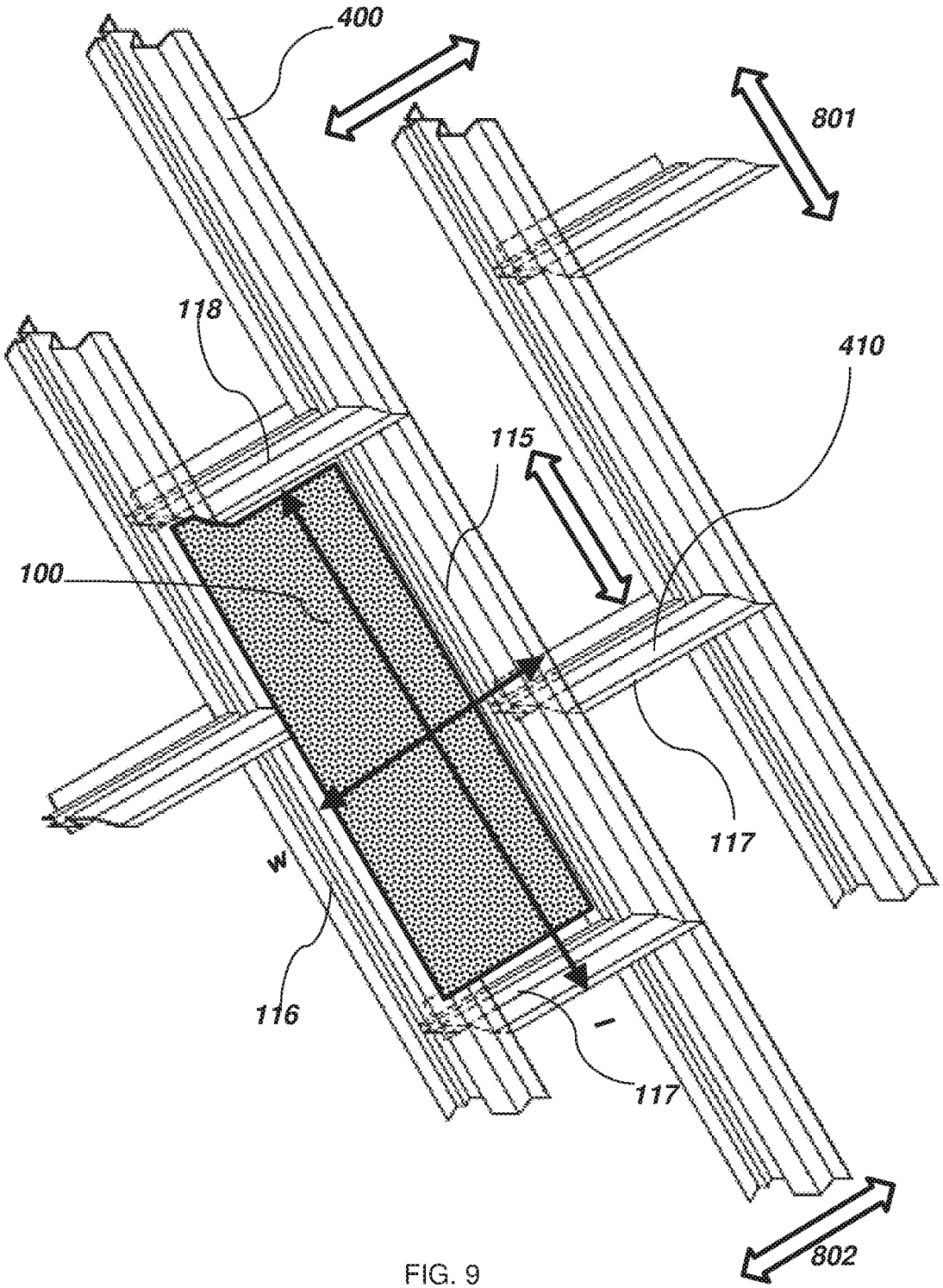
FIG. 9, illustrates an embodiment of the grid used for forming the thermally and moisture insulated bricks comprising natural, carved stone façade.
Figure 10:
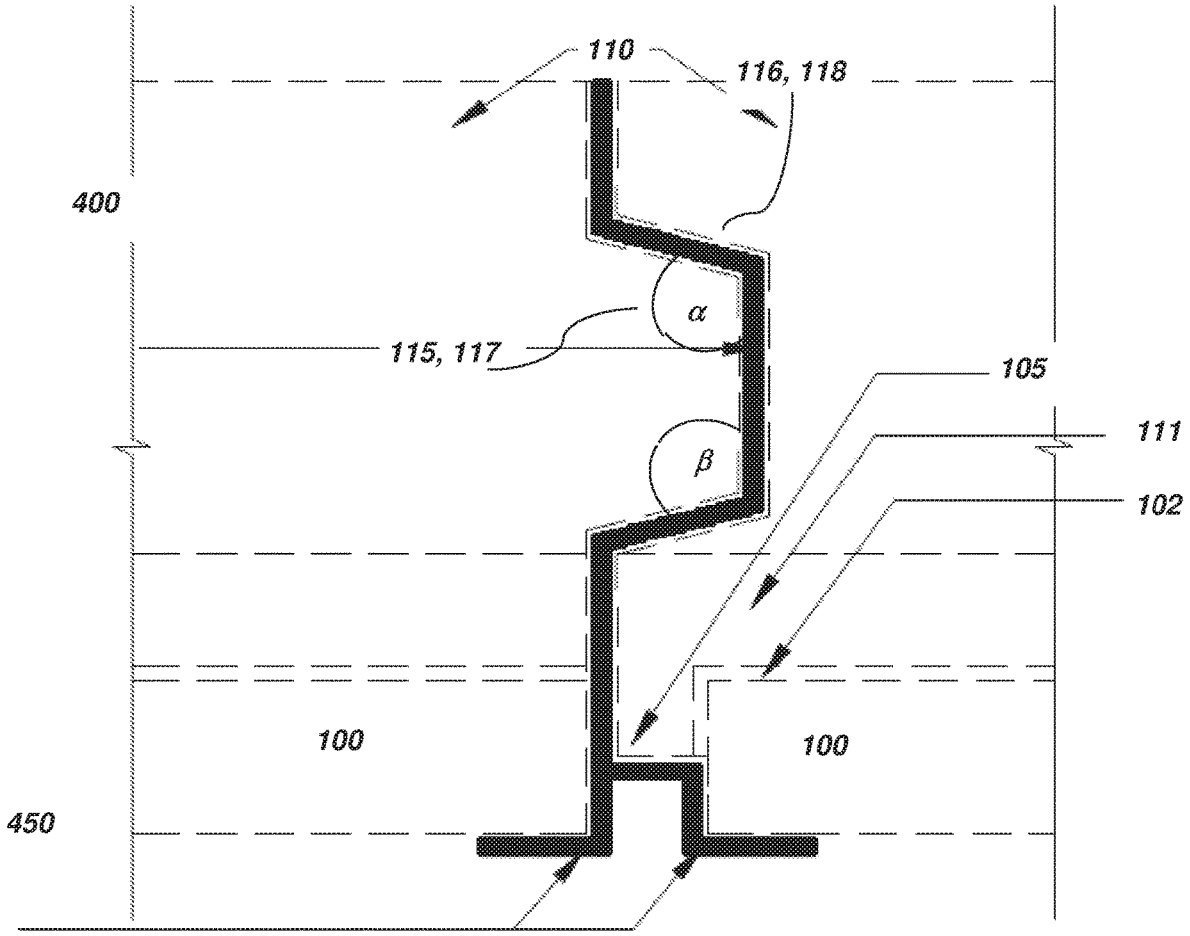
FIG. 10, is an illustration of an embodiment of the cross section of the frame used to mold the brick interface.

Turning now to FIGS. 7 and 8, illustrating built internal walls comprised of thermally and moisture insulated bricks 10, illustrating in FIG. 7, a single wall of carved natural stone façade 100, disposed between floor platform 200 and ceiling 300; with lower interface defining a groove 116 configured to receive and engage tongue 115 defined by the upper interface of an adjacent brick. Alternatively and in addition, FIG. 8, illustrates internal wall comprised of back-to-back facing bricks. Although shown in the center, walls of bricks 10 can be disposed at the edge of floor platform 200 and built up to ceiling platform 300 as illustrated in FIG. 11A. It should be noted that the bricks are arranged back-to-back and are not a single brick with natural stone on both side Turning now to FIGS. 9 and 10, illustrating an embodiment of the mold system used in certain embodiment to form bricks 10 described herein. As shown in FIG. 9, a quadrilateral brick mold comprised of parallel longitudinal rail 400 and parallel transverse rail 410 defining an open frame having upper interface 115, lower interface 116, a right interface 117 and left interface 118, wherein: upper 115 and lower 116 interfaces are identical and parallel, defining line cross section 400 with at least two angles α, β, therein; and right 117 and left 118 interfaces, being identical and parallel, defining line cross section 400 (see e.g., FIG. 10) with at least two angles α, β, therein. An uncarved, substantially rectangular slab 100 is positioned in brick mold, wherein the uncarved natural stone, that is substantially rectangular slab 100 forms the (incomplete) floor of the open frame comprised of longitudinal rail 400 and transverse rail 410 with the backing side of slab 100 which is rough (Ra, or average roughness of between about 0.5 mm and about 5 mm) to increase surface area and affect adherence can be used. A, for example concrete mixture comprising cement to sand at a ratio of between 1:1 and 1:3, can then poured onto longitudinal rail(s) 400 and transverse rail(s) 410, wherein the sand has particle size equal to or less than 1 mm into the frame, forming perimeter walls of an open box with straight internal sides rising above the backing face of slab 100, and tongue 115 on the upper interface and left 117 interface, and groove on the lower interface 116 and right interface 118. Intermediate moisture insulating layer 102 (see e.g., FIG. 10) can be deposited on slab 100, followed by depositing massive backing layer 111, followed by lightweight concrete mixture 110 (FIG. 10) atop intermediate moisture insulating layer 102, to the top of the box. As illustrated in FIG. 10, longitudinal rail 400 can further comprise support members 450, which can be used to position longitudinal rail 400 on a flat surface, as well as provide support uncarved slab 100. As further illustrated in FIG. 10, intermediate layer 102 can extend to gap 105 created in the mold, to ensure in certain embodiment that any exposed space between carved slabs of natural stone are waterproofed and if pigments are optionally used in the mixture for the intermediate layer, a visual marking of the interface is provided, thus providing an architectural element to brick 10.

As illustrated in FIG. 9 the grid can be comprised of main longitudinal rail 400 and main transverse rail 410, with secondary longitudinal rails 400' and secondary transverse rails 410', affecting bricks of different sizes configured to be interlocking regardless of the brick size.

Turning now to FIG. 11, illustrating in FIG. 11A cladding a structure having solid load-bearing concrete walls 500 with carved natural stone façade 100. As illustrated concrete pouring mold 500, having border 501 for the load bearing wall 510 (see e.g., FIG. 11B) is constructed on floor platform 200. A wall formed of rows and columns of the plurality of bricks 10 is erected between the floor platform 200 and ceiling 300, wherein first anchor embodiment 150 can extends as needed every predetermined number of rows (e.g., $3^{rd}$ or $4^{th}$ row) and predetermined number of columns (e.g., every $3^{rd}$ or $4^{th}$ column) into mold 500 having mold border 501. The load bearing concrete walls 510 (see e.g., FIG. 11B) are then poured into mold 500 with border 501, resulting in cladding of the load bearing walls with anchored bricks, without the need to use framing for the façade slabs on the outside of the structure as is the current methodology. As illustrated in FIG. 11B, First anchor embodiment 150 extends and engages concrete wall 510 after mold border 501 is removed. The decision of the location and frequency of anchors can be determined based on the thickness of the façade bricks, the height of the walls between floor and ceiling, thickness of the load-bearing concrete walls and any other factor that may affect the stress imposed on the façade bricks when the concrete walls are poured.

FIGS. 11C-11E, concrete pouring mold 500 (see e.g., FIG. 11A), having internal border 530 and external border 520 for non-load bearing wall 510 (see e.g., FIG. 11C) is constructed on floor platform 200. A wall formed of rows and columns of the plurality of bricks 10 is erected between the floor platform 200 and ceiling 300, wherein second anchor embodiment 150' (having a profile illustrated in FIG. 11E) can extends as needed every predetermined number of rows (e.g., 3rd or $4^{th}$ row) and predetermined number of columns (e.g., every $3^{rd}$ or $4^{th}$ column) into mold 500 having mold border 530 using couplers 550. In certain other embodiments, non load-bearing concrete walls 510 (see e.g., FIG. 11C) can then poured into mold 500 with border 530, resulting in cladding of the load bearing walls with anchored bricks, without the need to use framing for the façade slabs on the outside of the structure as is the current methodology. As illustrated in FIG. 11D, Anchor embodiment 150' extends and engages concrete wall 510 after mold border 530 is removed. Using anchor 150' it is possible to anchor the brick wall to light construction materials such as, for example, cinder blocks, dry walls and the like using couplers 550.

Additionally, or alternatively, FIGS. 11C-11E, likewise illustrate the cladding of a light structure having light, galvanized metal skeleton walls 530 with carved natural stone façade 100. As illustrated galvanized metal skeleton walls, having border 501 is constructed on floor platform 200. A wall formed of rows and columns of the plurality of bricks 10 is erected between the floor platform 200 and ceiling 300, wherein anchor member 151 extends every $3^{rd}$ or $4^{th}$ row and every $3^{rd}$ or $4^{th}$ column into galvanized metal skeleton walls 530 having mold border 501. Dry wall, or cement board 540 (not shown) can then be coupled to border 501 of galvanized metal skeleton walls 530, resulting in cladding of the galvanized metal skeleton walls 530 with anchored bricks, without the need to use framing for the façade slabs 10 on the outside of the structure as is the current methodology. As illustrated in FIG. 11D, Anchor member 151 extends and engages galvanized metal skeleton walls 530, with fixing means 502 while brick 10 can be fixed with anchor member 151 using the same or different fixing means 503 (e.g., screw, nail, and the like). As illustrated in FIG. 11E, anchor member 11E can be made from metal, such as aluminum and have a substantially flat profile that can be complimentary to the profile defined by the periphery of brick 10, thus providing tight tolerances and preventing moisture migration.

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

The invention claimed is:

1. An interlocking masonry brick having a front surface, a backing, an upper interface, a lower interface, a left interface and a right interface comprising:

a. a carved natural stone façade forming the front surface;

b. a backing layer comprising a first backing layer of concrete having a density of 2200 kg/m$^3$ and a second backing layer of concrete having a density of between about 200 kg/m$^3$ and about 1000 kg/m$^3$; and c. an intermediate layer sandwiched between the carved natural stone façade and the first backing layer or the second backing layer, the intermediate layer deposited onto the carved natural stone façade, wherein the second backing layer is deposited onto the first backing layer, wherein the lower interface defines a groove configured to receive and engage a tongue defined by the upper interface of an adjacent brick, and wherein the left interface defines a groove configured to receive and engage a tongue defined by the right interface of an adjacent brick, the upper, lower, right and left interfaces comprised of concrete that is different or the same as the concrete of the second backing layer.

2. The brick of claim 1, wherein the carved natural stone is granite, gabbro, granodiorite, syenite, larvikite, diorite, gabbro, rhyolite, quartz porphyr, andesite, trachyte, kuselite, porphyr, basalt, lava, melaphyr, diabase, picrite, marble, gneiss, serpentinite, limestone, Jura limestone, shell limestone, travertine, dolomite, onyx, alabaster, sandstone, glauconite sandstone, greywacke, shale, quartzite, or a stone comprising a combination of one or more of the foregoing.

3. The brick of claim 2, wherein the uncarved natural stone is finished on the brick.

4. The brick of claim 3, wherein the finished carved natural stone veneer has an average thickness of between about 5 mm and about 50 mm.

5. The brick of claim 1, wherein the second backing layer is a concrete backing layer, further comprising between about 20% and 70% (v/v) expanded particles having n $D_{3,2}$ of between about 1.0 and about 8.0 mm.

6. The brick of claim 1, wherein the thickness ratio between the second backing layer and the first backing layer is between about 1:1 and 10:1.

7. The brick of claim 6, wherein the intermediate layer comprises grout with thickness of between about 1 mm and about 4 mm.

8. The brick of claim 1, wherein the interlocking masonry brick's total weight is configured to be equal to or greater than the weight of a 100% stone brick, panel, slab or block of the same area, at a thickness of about 50 mm.

9. The brick of claim 1, wherein the upper, lower, left and right interfaces are formed of a mixture comprising cement to sand at a ratio between 1:1 and 1:3, wherein the sand has particle size of about 1 mm.

10. The brick of claim 9, wherein the interfaces are coated with an additional moisture barrier.

11. The brick of claim 9, wherein the groove in the lower interface and left interface, is configured to receive and engage the tongue in the upper interface and the right interface, causing the carved stone façade of a first brick to abut the carved stone façade of a second adjacent brick.

* * * * *